US011730329B2

(12) United States Patent
Brown

(10) Patent No.: US 11,730,329 B2
(45) Date of Patent: Aug. 22, 2023

(54) AUTONOMOUS FLOOR CLEANER AND DOCKING STATION

(71) Applicant: BISSELL Inc., Grand Rapids, MI (US)

(72) Inventor: Adam Brown, Holland, MI (US)

(73) Assignee: BISSELL Inc., Grand Rapids, MI (US)

( * ) Notice: Subject to any disclaimer, the term of this patent is extended or adjusted under 35 U.S.C. 154(b) by 368 days.

(21) Appl. No.: 17/106,243

(22) Filed: Nov. 30, 2020

(65) Prior Publication Data

US 2021/0169291 A1 Jun. 10, 2021

Related U.S. Application Data

(60) Provisional application No. 62/944,602, filed on Dec. 6, 2019.

(51) Int. Cl.
*A47L 9/28* (2006.01)
*A47L 11/40* (2006.01)

(52) U.S. Cl.
CPC ..... *A47L 9/2873* (2013.01); *A47L 9/2852* (2013.01); *A47L 11/4011* (2013.01); *A47L 11/4013* (2013.01); *A47L 11/4083* (2013.01); *A47L 2201/022* (2013.01); *A47L 2201/04* (2013.01)

(58) Field of Classification Search
CPC .. A47L 9/2873; A47L 9/2852; A47L 11/4011; A47L 11/4013; A47L 11/4083; A47L 2201/022; A47L 2201/04; A47L 2201/00; A47L 2201/02; A47L 2201/024; A47L 2201/026; A47L 2201/06
See application file for complete search history.

(56) References Cited

U.S. PATENT DOCUMENTS

| | | | | |
|---|---|---|---|---|
| 9,853,468 | B2 | 12/2017 | Ireland | |
| 2008/0047092 | A1* | 2/2008 | Schnittman | A47L 11/4025 15/3 |
| 2014/0184144 | A1 | 7/2014 | Henricksen et al. | |
| 2016/0150934 | A1* | 6/2016 | Kim | A47L 9/0686 15/300.1 |
| 2019/0069379 | A1* | 2/2019 | Kastee | F21V 23/003 |
| 2019/0202064 | A1* | 7/2019 | Wolff | A47L 9/2873 |

FOREIGN PATENT DOCUMENTS

| | | | | |
|---|---|---|---|---|
| CN | 108075509 | A * | 5/2018 | A47L 11/24 |
| CN | 109589050 | A * | 4/2019 | A47L 11/4011 |
| WO | 2007137234 | A2 | 11/2007 | |
| WO | 2019054129 | A1 | 3/2019 | |

OTHER PUBLICATIONS

English translation of CN108075509A (Year: 2018).*
English translation of CN109589050A (Year: 2019).*

* cited by examiner

*Primary Examiner* — Brian D Keller
*Assistant Examiner* — Sukwoo James Chang
(74) *Attorney, Agent, or Firm* — Warner Norcross + Judd LLP

(57) ABSTRACT

An autonomous floor cleaning system includes an interlock for physically interlocking an autonomous floor cleaner with a docking station. The interlock selectively engages when the robot is docked at the docking station, and can automatically engage as when a predefined locking criterion is met. The interlock can remain engaged until a predefined unlocking criterion is met. Methods for docking an autonomous floor cleaner with a docking station are disclosed.

19 Claims, 7 Drawing Sheets

AUTONOMOUS FLOOR CLEANER AND DOCKING STATION

CROSS-REFERENCE TO RELATED APPLICATION(S)

The present application claims the benefit of U.S. Provisional Patent Application No. 62/944,602, filed Dec. 6, 2019, which is incorporated herein by reference in its entirety.

BACKGROUND

Autonomous or robotic floor cleaners can move without the assistance of a user or operator to clean a floor surface. For example, the floor cleaner can be configured to vacuum or sweep dirt (including dust, hair, and other debris) into a collection bin carried on the floor cleaner. Some floor cleaners are further configured to apply and extract liquid for wet cleaning of bare floors, carpets, rugs, and other floor surfaces. The floor cleaner can move randomly about a surface while cleaning the floor surface or use a mapping/navigation system for guided navigation about the surface. Many autonomous floor cleaners need to return to a docking station to recharge their battery and/or empty the collection bin.

BRIEF SUMMARY

The disclosure relates to an autonomous floor cleaner and to a docking station for an autonomous floor cleaner. Various methods for docking an autonomous floor cleaner with a docking station are described herein.

In one aspect, an autonomous floor cleaner includes an autonomously moveable housing, a drive system for autonomously moving the housing over the surface to be cleaned, a controller for controlling the operation of the autonomous floor cleaner, and interchangeable modules for different modes of operation.

In another aspect, an autonomous floor cleaner includes an autonomously moveable housing, a drive system for autonomously moving the housing over the surface to be cleaned, a controller for controlling the operation of the autonomous floor cleaner, and one of a lockable member which is engaged by a lock on a docking station, or a lock which engages a lockable member on a docking station.

In yet another aspect, a docking station for an autonomous floor cleaner includes one of a lock that engages a lockable member on the autonomous floor cleaner, or a lockable member that is engaged by a lock on the autonomous floor cleaner.

In still another aspect, a docking station for an autonomous floor cleaner includes a foldable portion moveable between a docking position and a stowed position. In the docking position, an autonomous floor cleaner can dock with the docking station. In the stowed position, the foldable portion moves to raise the robot off a floor surface. An interlock feature can physically interlock the foldable portion and autonomous floor cleaner together when moving from the docking position to the stowed position.

In a further aspect, the disclosure relates to an autonomous floor cleaning system including an autonomous floor cleaner and a docking station. An interlock feature can physically interlock the autonomous floor cleaner to the docking station when docked.

In still a further aspect, a method for docking an autonomous floor cleaner with a docking station includes docking the autonomous floor cleaner at the docking station, determining if a predefined locking criterion is met, and interlocking the autonomous floor cleaner with the docking station if the predefined locking criterion is met.

In yet a further aspect, a method for docking an autonomous floor cleaner with a docking station includes docking the autonomous floor cleaner at the docking station, interlocking the autonomous floor cleaner with the docking station, determining if a predefined unlocking criterion is met, and unlocking the autonomous floor cleaner from the docking station if the predefined unlocking criterion is met.

In still a further aspect, a method for docking an autonomous floor cleaner with a docking station includes docking the autonomous floor cleaner at the docking station, interlocking the autonomous floor cleaner with the docking station, and moving the autonomous floor cleaner to a stowed position.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DETAILED DESCRIPTION

The disclosure generally relates to the docking of autonomous floor cleaners with docking stations.

Figure 1:
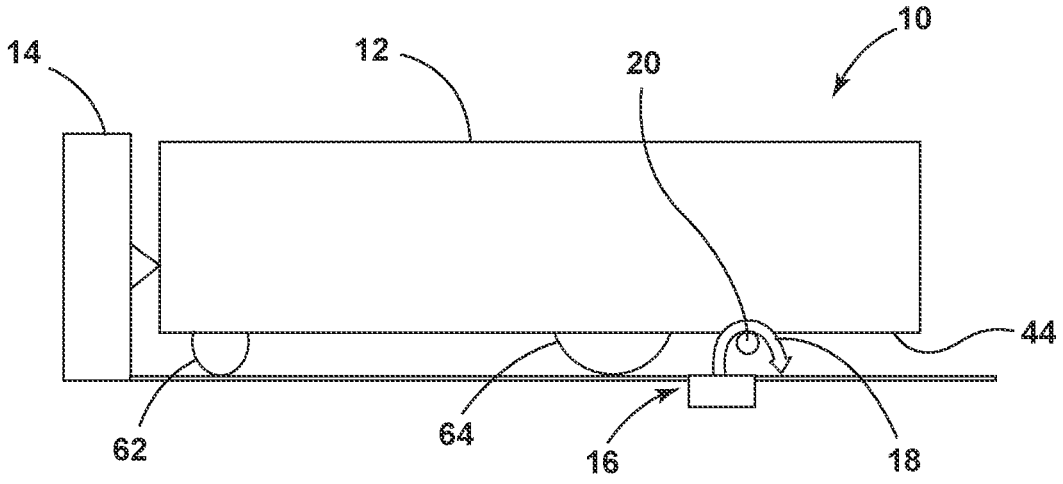
FIG. 1 is a schematic view of an autonomous floor cleaning system according to one embodiment of the invention, the system including at least an autonomous floor cleaner, or robot, and a docking station.

FIG. 1 is a schematic view of an autonomous floor cleaning system 10 according to one embodiment of the invention. The autonomous floor cleaning system 10 includes an autonomous floor cleaner 12 and a docking station 14 for the autonomous floor cleaner 12, also referred to herein as a robot. The robot 12 can clean various floor surfaces, including bare floors such as hardwood, tile, and stone, and soft surfaces such as carpets and rugs. Optionally, the system 10 can include an artificial barrier system (not shown) for containing the robot 12 within a user-determined boundary.

The robot 12 can be interlocked with the docking station 14, and can remain locked (preventing separation of the robot 12 from the docking station 14) unless certain criteria are present or until a predefined criterion is met. The system 10 includes an interlock feature 16 for physically interlocking the robot 12 and docking station 14. As shown in FIG. 1, the interlock feature 16 can comprise a locking mechanism including a lock 18 on the docking station 14 that selectively engages the robot 12 when the robot 12 is docked, i.e. parked at the docking station 14. The robot 12 can have a lockable member 20 that is engaged by the lock 18. In another embodiment, the lock 18 can be provided on the robot 12 and the lockable member 20 can be provided on the docking station 14.

In one embodiment, the lock 18 can comprise a shackle or U-shaped member that loops around from, and back into, a housing of the docking station 14. The shackle or U-shaped member can loop around or through the lockable member 20 on the robot 12 when the robot 12 is docked. For example, the lockable member 20 can comprise an opening through which the shackle can pass. Other configurations for the lock 18 and lockable member 20 are possible. For example, the lock 18 can comprise an L-shaped member that engages the lockable member 20 on the robot 12.

In one embodiment, the robot 12 can be a deep cleaning robot including a fluid delivery system for storing cleaning fluid and delivering the cleaning fluid to the surface to be cleaned and a fluid recovery system for removing the cleaning fluid and debris from the surface to be cleaned and storing the recovered cleaning fluid and debris. The fluid delivery system may be configured to delivery liquid, steam, mist, or vapor to the surface to be cleaned.

In another embodiment, the robot 12 can be a wet mopping or sweeping robot including a fluid delivery system for storing cleaning fluid and delivering the cleaning fluid to the surface to be cleaned and a mopping or sweeping system for removing cleaning fluid and debris from the surface to be cleaned without the use of suction. The fluid delivery system may be configured to delivery liquid, steam, mist, or vapor to the surface to be cleaned.

In yet another embodiment, the robot 12 can be a dry vacuum cleaning robot including at least a vacuum collection system for creating a partial vacuum to suck up debris (which may include dirt, dust, soil, hair, and other debris) from a floor surface, and collect the removed debris in a space provided on the robot for later disposal.

In still another embodiment, the robot 12 can be a dry sweeping robot including a sweeping system for removing dry debris from the surface to be cleaned without the use of suction, and collect the removed debris in a space provided on the robot for later disposal.

Figure 2:
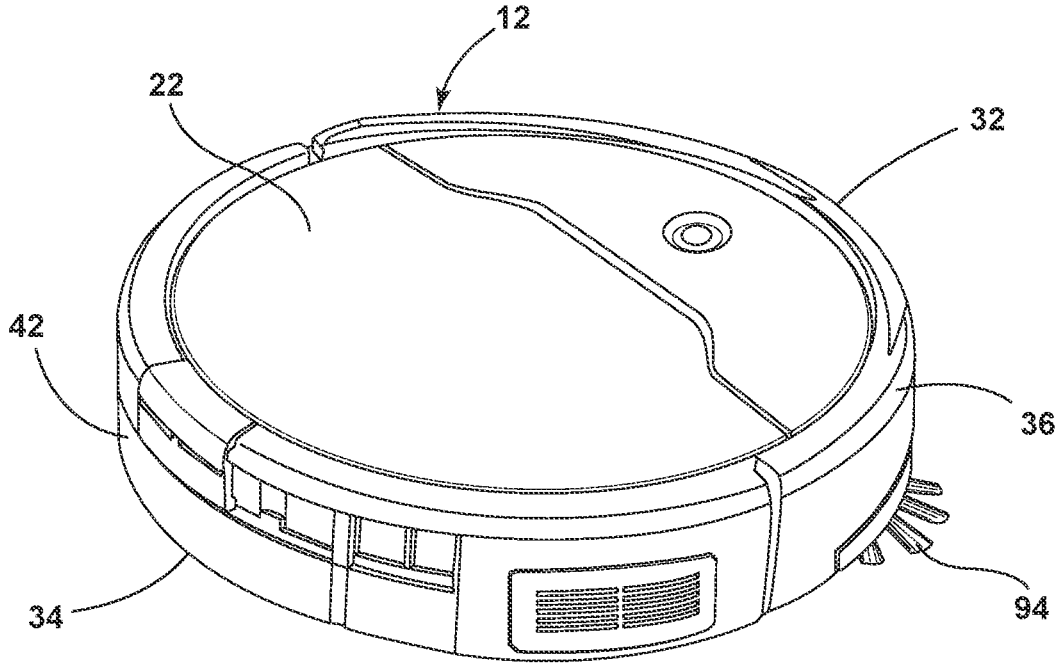
FIG. 2 is a perspective view of one embodiment of an autonomous floor cleaner or robot for the system of FIG. 1.
Figure 3:
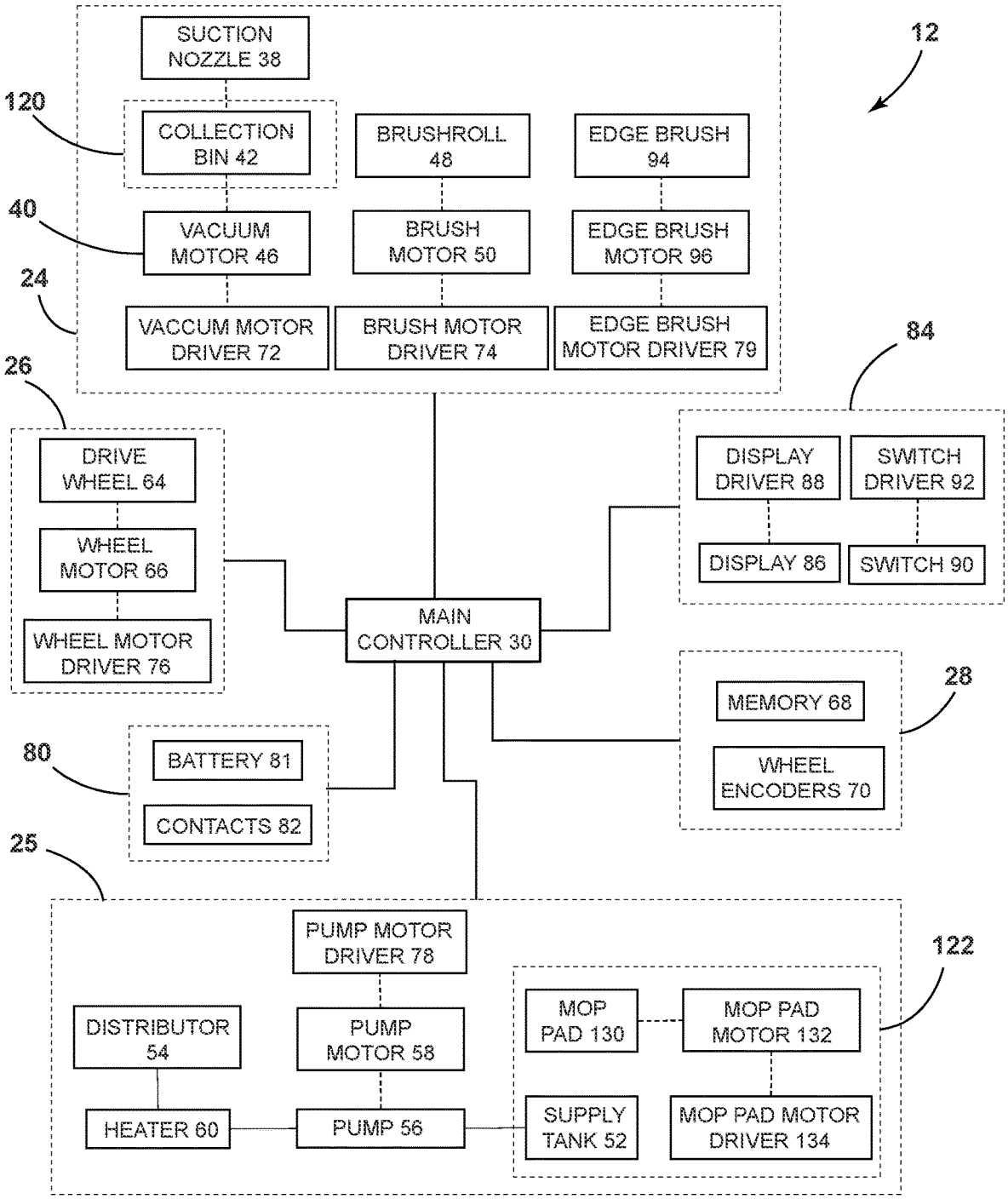
FIG. 3 is a schematic view of the robot from FIG. 2.

FIGS. 2-3 illustrate one embodiment of the robot 12 for the system 10 of FIG. 1. It is noted that the robot 12 shown in FIGS. 2-3 is but one example of an autonomous floor cleaner that is usable with the system 10 and with the docking station 14, and that other autonomous floor cleaners can be used with the system 10 and docking station 14.

The robot 12 mounts the components various functional systems of the autonomous floor cleaner in an autonomously moveable unit or housing 22, optionally including components of a collection system 24, a fluid delivery system 25, a drive system 26, a navigation/mapping system 28, or any combination thereof. A controller 30 is operably coupled with the various functional systems 24, 25, 26, 28 of the robot 12 for controlling the operation of the robot 12. The controller 30 can be a microcontroller unit (MCU) that contains at least one central processing unit (CPU).

As shown, the housing 22 of the robot 12 can be a circular, with a first end 32 and a second end 34. The first end 32 defines the front of the robot 12 and can optionally comprise a bumper 36. The second end 34 can define the rear of the robot 12 and optionally comprise a module receiver, as described in further detail below. Other shapes and configurations for the robot 12 are possible, including a D-shaped housing.

FIG. 3 is a schematic view of the robot 12 from FIG. 2. The collection system 24 can include a working air path through the unit having an air inlet and an air outlet, a suction nozzle 38, a suction source 40 in fluid communication with the suction nozzle 38 for generating a working air stream, and a collection bin 42 for collecting dirt and/or liquid from the working airstream for later disposal. The suction nozzle 38 can define the air inlet of the working air path, with the inlet opening of the suction nozzle 38 provided on an underside 44 (FIG. 1) of the housing 22 and facing a surface to be cleaned. The suction source 40 can include a vacuum motor 46 carried by the housing 22, fluidly upstream of the air outlet (not shown), and can define a portion of the working air path. The collection bin 42 can also define a portion of the working air path, and comprise a dirt bin inlet (not shown) in fluid communication with the suction nozzle 38. Optionally, a separator (not shown) can be formed in a portion of collection bin 42 for separating fluid and entrained dirt from the working airstream. Some non-limiting examples of separators include a cyclone separator, a filter screen, a foam filter, a HEPA filter, a filter bag, or combinations thereof. Optionally, a pre-motor filter and/or a post-motor filter (not shown) can be provided in the working air path as well. The working air path can further include various conduits, ducts, or tubes for fluid communication between the various components of the collection system 24. The vacuum motor 46 can be positioned fluidly downstream or fluidly upstream of the collection bin 42 in the working air path.

The collection system 24 can also include at least one agitator for agitating the surface to be cleaned. The agitator can be in the form of a brushroll 48 mounted for rotation about a substantially horizontal axis, relative to the surface over which the robot 12 moves. A drive assembly including a brush motor 50 can be provided within the robot 12 to drive the brushroll 48. Other agitators or brushrolls can also be provided, including one or more stationary or non-moving brushes, or one or more brushes that rotate about a substantially vertical axis.

The suction nozzle 38 can be positioned in close proximity to the brushroll 48 to collect liquid and debris directly from the brushroll 48. In other embodiments, the suction nozzle 38 can be positioned to confront the surface to be cleaned to remove liquid and debris from the surface, rather than the brushroll 48.

Referring to FIG. 2, optionally, the robot 12 includes at least one edge brush 94 that can clean hard-to reach spaces such as along edges and in corners of a room, including edges or corners created by walls, baseboards, cabinetry, furniture, etc. The edge brush 94 can sweep debris under the housing 22 and toward the suction nozzle 38. The edge brush 94 can comprise one or more different agitation or cleaning elements configured to brush, sweep, dust, mop, or otherwise move debris on the surface to be cleaned. Some non-limiting examples of cleaning elements for the edge cleaning brush comprise blades, bristles, paddles, blades, flaps, microfiber material, fabric, dusting pads, and the like.

Referring to FIG. 3, a drive assembly including an edge brush motor 96 can be provided within the robot 12 to drive the edge brush 94. The brush motor 96 is configured to drive at least a portion of the edge brush 94 about a substantially vertical rotational axis, relative to the surface to be cleaned.

In another embodiment, the collection system 24 can be configured as a sweeping system that removes dry debris from the floor surface without the use of suction. In this case, the suction source 40 may not be provided.

The fluid delivery system 25 can include a supply tank 52 for storing a supply of cleaning fluid and at least one fluid distributor 54 in fluid communication with the supply tank 52 for depositing a cleaning fluid onto the surface. The cleaning fluid can be a liquid such as water or a cleaning solution specifically formulated for hard or soft surface cleaning. The fluid distributor 54 can be one or more spray nozzles provided on the housing 22 with an orifice of sufficient size such that debris does not readily clog the nozzle. Alternatively, the fluid distributor 54 can be a manifold having multiple distributor outlets.

A pump 56 can be provided in the fluid pathway between the supply tank 52 and the at least one fluid distributor 54 to control the flow of fluid to the at least one fluid distributor 54. The pump 56 can be driven by a pump motor 58 to move liquid at any flowrate useful for a cleaning cycle of operation.

Various combinations of optional components can also be incorporated into the fluid delivery system 25, such as a heater 60 or one or more fluid control and mixing valves. The heater 60 can be configured, for example, to warm up the cleaning fluid before it is applied to the surface. In one embodiment, the heater 60 can be an in-line fluid heater between the supply tank 52 and the distributor 54. In another example, the heater 60 can be a steam generating assembly. The steam assembly is in fluid communication with the supply tank 52 such that some or all the liquid applied to the floor surface is heated to vapor.

The drive system 26 can include drive wheels 64 for driving the robot 12 across a surface to be cleaned. The drive wheels 64 can be operated by a common wheel motor 66 or individual wheel motors 66 coupled with the drive wheels 64 by a transmission, which may include a gear train assembly or another suitable transmission. The drive system 26 can receive inputs from the controller 30 for driving the robot 12 across a floor, based on inputs from the navigation/mapping system 28 for the autonomous mode of operation or based on inputs from a smartphone, tablet, or other remote device for an optional manual mode of operation. The drive wheels 64 can be driven in a forward or reverse direction to move the unit forwardly or rearwardly. Furthermore, the drive wheels 64 can be operated simultaneously at the same rotational speed for linear motion or independently at different rotational speeds to turn the robot 12 in a desired direction. While the drive system 26 is shown herein as including rotating wheels 64, it is understood that the drive system 26 can comprise alternative traction devices for moving the robot 12 across a surface to be cleaned.

In addition to the drive wheels 64 or other traction devices, the robot 12 can include one or more additional wheels 62 that support the housing 22, such as a castor wheel at a center, rear portion of the underside 44 of the housing 22, as shown in FIG. 1.

The controller 30 can receive input from the navigation/mapping system 28 or from a remote device such as a smartphone (not shown) for directing the robot 12 over the surface to be cleaned. The navigation/mapping system 28 can include a memory 68 that can store any data useful for navigation, mapping or conducting a cycle of operation, including, but not limited to, maps for navigation, inputs from various sensors that are used to guide the movement of the robot 12, etc. For example, wheel encoders 70 can be placed on the drive shafts of the drive wheels 64 and configured to measure a distance traveled by the robot 12. The distance measurement can be provided as input to the controller 30.

In an autonomous mode of operation, the robot 12 can be configured to travel in any pattern useful for cleaning or sanitizing including boustrophedon or alternating rows (that is, the robot 12 travels from right-to-left and left-to-right on alternate rows), spiral trajectories, etc., while cleaning the floor surface, using input from various sensors to change direction or adjust its course as needed to avoid obstacles. In the optional manual mode of operation, movement of the robot 12 can be controlled using a mobile device such as a smartphone or tablet.

The robot 12 can include any number of motors useful for performing locomotion and cleaning and any number of motor drivers for controlling the motors. In the embodiment shown, a vacuum motor driver 72, a brushroll motor driver 74, a wheel motor driver 76, a pump motor driver 78, and an edge brush motor driver 79 can be provided for controlling the vacuum motor 46, brush motor 50, wheel motors 66, pump motor 58, and edge brush motor 96, respectively. The motor drivers can act as an interface between the controller 30 and their respective motors. The motor drivers can be an integrated circuit chip (IC). It is also contemplated that a single wheel motor driver 76 can control multiple wheel motors 66 simultaneously.

The motor drivers can be electrically coupled to a battery management system 80 that includes a rechargeable battery 81, which may comprise battery pack. In one example, the battery pack can comprise a plurality of can include lithium ion batteries. Batteries with other cell chemistries, such as nickel metal hydride and nickel cadmium, are also possible. Electrical contacts or charging contacts 82 for the battery 81 can be provided on an exterior surface of the robot 12. In one embodiment, the charging contacts 82 are provided on the underside 44 of the robot 12. In another embodiment, the charging contacts 82 are provided on the second end or rear side 34 of the robot 12.

In one embodiment, positive and negative charging contacts 82 are utilized to detect a completed circuit when the robot 12 docks with the docking station 14. In other embodiments, a single charging contact 82 or more than two charging contacts 82 may be utilized. An additional charging contact would provide redundancy in the event that one of the other charging contacts becomes dirty, obstructed, or damaged. In still other embodiments of the robot 12, additional contacts may be used to transmit data and information between the robot 12 and docking station 14.

The controller 30 is further operably coupled with a user interface (UI) 84 on the robot 12 for receiving inputs from a user. The UI 84 can be used to select an operation cycle for the robot 12 or otherwise control the operation of the robot 12. The UI 84 can have a display 86, such as an LED display, for providing visual notifications to the user. A display driver 88 can be provided for controlling the display 86, and acts as an interface between the controller 30 and the display 86. The display driver 88 may be an IC. The robot 12 can be provided with a speaker (not shown) for providing audible notifications to the user.

The UI 84 can further have one or more switches 90 that are actuated by the user to provide input to the controller 30 to control the operation of various components of the robot 12. A switch driver 92 can be provided for controlling the switch 90, and acts as an interface between the controller 30 and the switch 90.

The robot 12 can be provided with one or more cameras or stereo cameras (not shown) for acquiring visible notifications from the user. In this way, the user can communicate instructions to the robot 12 by gestures. For example, the user can wave their hand in front of the camera to instruct the robot 12 to stop or move away. In one embodiment, the user can execute a gesture in front of the camera that instructs the robot 12 to dock with the docking station 14.

The robot 12 can comprise an on-board Wi-Fi connection that is configured to allow the robot 12 to be controlled remotely through a mobile device, such as a smartphone or tablet, or via a voice-controlled remote device such as an Amazon Echo® or Amazon Echo Dot® having the Amazon Alexa® cloud-based voice service, or a Google Home® or Google Home Mini® having Google Assistant. For example, a user with a smart speaker device can speak an instruction, such as "Alexa, ask [robot] to start cleaning," and via the Wi-Fi and/or Internet connectivity, the robot 12 can begin a cleaning cycle of operation.

A smart device application for the robot 12 that is executed on a mobile or remote device can include further command and control features including, but not limited to, scheduling features to enable a user to select when the robot 12 will conduct cleaning. Other features of the smart device application cam include a display of the robot's cleaning history, a landing page with current blogs and support videos related to the robot 12, and controls to automatically reorder accessories for the robot 12 when needed. The smart device application can also be configured to provide detailed notifications relating diagnostics, error warnings, and other information directly to the user.

The controller 30 can be operably coupled with various sensors on board the robot 12 for receiving input about the environment and from the docking station 14, and can use the sensor input to control the operation of the robot 12. The sensors can detect features of the surrounding environment of the robot 12 including, but not limited to, the docking station 14, walls, floors, chair legs, table legs, footstools, pets, consumers, and other obstacles. The sensor input can further be stored in the memory 68 or used to develop maps by the navigation/mapping system 28. Some exemplary sensors are illustrated in FIG. 3, and described below. Although it is understood that not all sensors shown may be provided, additional sensors may be provided, and that all of the possible sensors can be provided in any combination.

The robot 12 can include one or more distance sensor(s) 100 for position/proximity sensing. The distance sensors 100 can be mounted to the housing 22 of the robot 12, such as in the front of the housing 22 to determine the distance to obstacles in front of the robot 12. Input from the distance sensors 100 can be used to slow down, turn, and/or adjust the course of the robot 12 when objects are detected. In one embodiment, the robot 12 can dock with the docking station 14 based on input from the distance sensors 100.

The robot 12 may include one or more of a bump sensor 102, a wall following sensor 104, a cliff sensor 106, an inertial measurement unit (IMU) 108, a lift-up sensor 110, a bin or tank sensor 112, or a floor condition sensor 114, including any combination or multiples thereof.

The bump sensor 102 determines front or side impacts to the robot 12, and may be integrated with the housing 22, such as with a bumper 36 (FIG. 2). Output signals from the bump sensors 102 provide inputs to the controller 30 for selecting an obstacle avoidance algorithm.

The wall following sensor 104 (also known as a side wall sensor) can be located near the side of the housing 22 and can include a side-facing position sensor that provides distance feedback and controls the robot 12 so that the robot 12 can follow near a wall without contacting the wall. The wall following sensor 104 can be an optical, mechanical, or ultrasonic sensor, including a reflective or time-of-flight sensor. In another embodiment, a wall following sensor is not provided, and the distance sensors 100 are instead used as wall following sensors.

The cliff sensor 106 can be a ground-facing position sensor that provides distance feedback so that the robot 12 can avoid excessive drops down stairwells, ledges, etc. The cliff sensor 106 can be an optical, mechanical, or ultrasonic sensor, including a reflective or time-of-flight sensor.

The IMU 108 can measure and report the robot's acceleration, angular rate, or magnetic field surrounding the robot 12, using a combination of at least one accelerometer, gyroscope, and, optionally, magnetometer or compass. The IMU 108 can be an integrated inertial sensor located on the controller 30 and can be a nine-axis gyroscope or accelerometer to sense linear, rotational or magnetic field acceleration. The IMU 108 can use acceleration input data to calculate and communicate change in velocity and pose to the controller 30 for navigating the robot 12 around the surface to be cleaned.

The lift-up sensor 110 can detect when the robot 12 is lifted off the surface to be cleaned e.g. if a user picks up the robot 12. This information is provided as an input to the controller 30, which can halt operation of the motors 46, 50, 58, 66 in response to a detected lift-up event. The lift-up sensor 110 may also detect when the robot 12 is in contact with the surface to be cleaned, such as when the user places the robot 12 back on the ground. Upon such input, the controller 30 may resume operation.

The robot 12 can optionally include one or more sensors 112 for detecting a characteristic or status of the collection bin 42 or supply tank 52. In one example, one or more pressure sensors for detecting the weight of the collection bin 42 or supply tank 52 can be provided. In another example, one or more magnetic sensors for detecting the presence of the collection bin 42 or supply tank 52 can be provided. This information is provided as an input to the controller 30, which may prevent operation of the robot 12 until the collection bin 42 is emptied, the supply tank 52 is filled, or either is properly installed on the housing 22, in non-limiting examples. The controller 30 may also direct the user interface 84 to provide a notification to the user that the collection bin 42 is full, the supply tank 52 is empty, or that neither is installed.

The floor condition sensor 114 detects a condition of the surface to be cleaned. For example, the robot 12 can be provided with an infrared (IR) dirt sensor, a stain sensor, an odor sensor, or a wet mess sensor. The floor condition sensor 114 provides input to the controller 30 that may direct operation of the robot 12 based on the condition of the surface to be cleaned, such as by selecting or modifying a cleaning cycle. Optionally, the floor condition sensor 114 can also provide input for display on a smartphone.

The robot 12 can have at least one receiver 116 to detect signals emitted from the docking station 14. In one embodiment, a docking signal from the docking station 14 can be transmitted to the robot 12 and received by the receiver 116 to guide the robot 12 to the docking station 14.

The robot 12 can operate in one of a set of modes. The modes can include at least a dry mode and a wet mode. During the wet mode of operation, liquid is applied to the floor surface. During the dry mode of operation, no liquid is applied to the floor surface.

In one embodiment, the robot 12 has interchangeable modules 120, 122 for the dry mode and the wet mode, respectively. Each module 120, 122 can be installed and removed from the housing 22 as a unit. The housing 22 of the robot 12 includes a module receiver 124 in which the modules 120, 122 can be installed, one at a time. In the embodiment shown, the module receiver 124 can be located at the second end 34 of the housing 22, for installation of removal of modules through the rear of the robot 12. Other locations for the module receiver 124 are possible.

The modules 120, 122 can be removable from the module receiver 124 while the robot 12 is docked and interlocked with the docking station 14. In one embodiment, the interlock feature 16 can be configured to physically interlock the housing 22 of the robot 12 with the docking station, and not the module 120, 122. For example, the lockable member 20 can be disposed in a location on the housing 22 where the engagement by the lock 18 does not interfere with the removal of the module 120, 122. In another embodiment, the lock 18 is provided on the robot 12 and the lockable member 20 is provided on the docking station 14, the lock 18 can be disposed in a location on the housing 22 where the movement of the lock 18 and engagement with the lockable member 20 does not interfere with the removal of the module 120, 122. In either case, when the robot 12 is docked and interlocked with the docking station 14, the modules 120, 122 can be removed from the housing 22 for emptying or refilling, while the housing 22 remains locked to the docking station 14.

Figure 4:
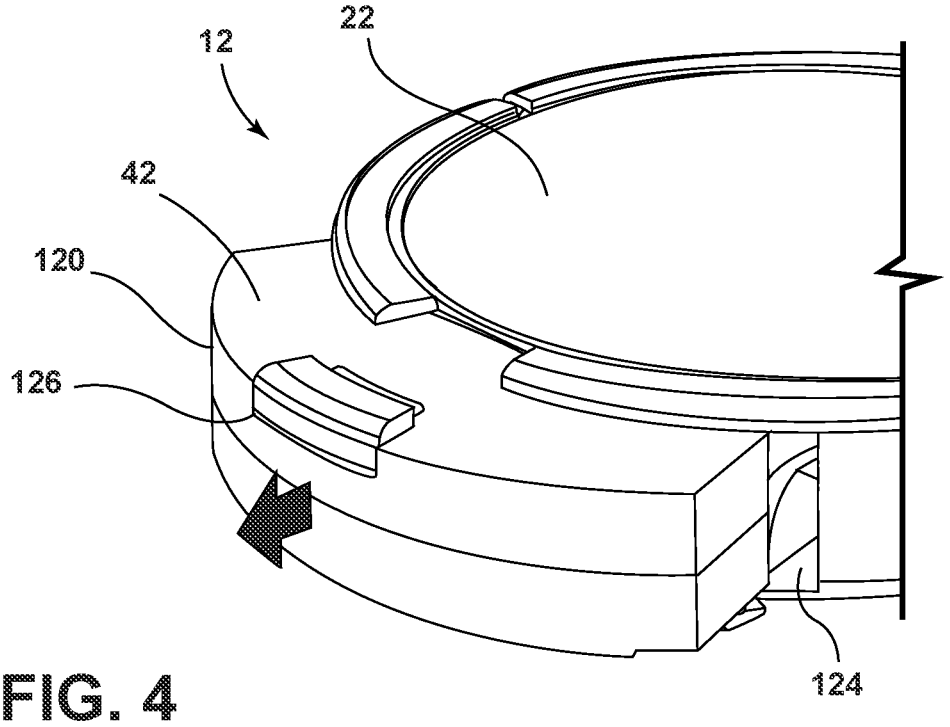
FIG. 4 is an enlarged view of portion of the robot, showing the installation of a dry module on the robot.
Figure 5:
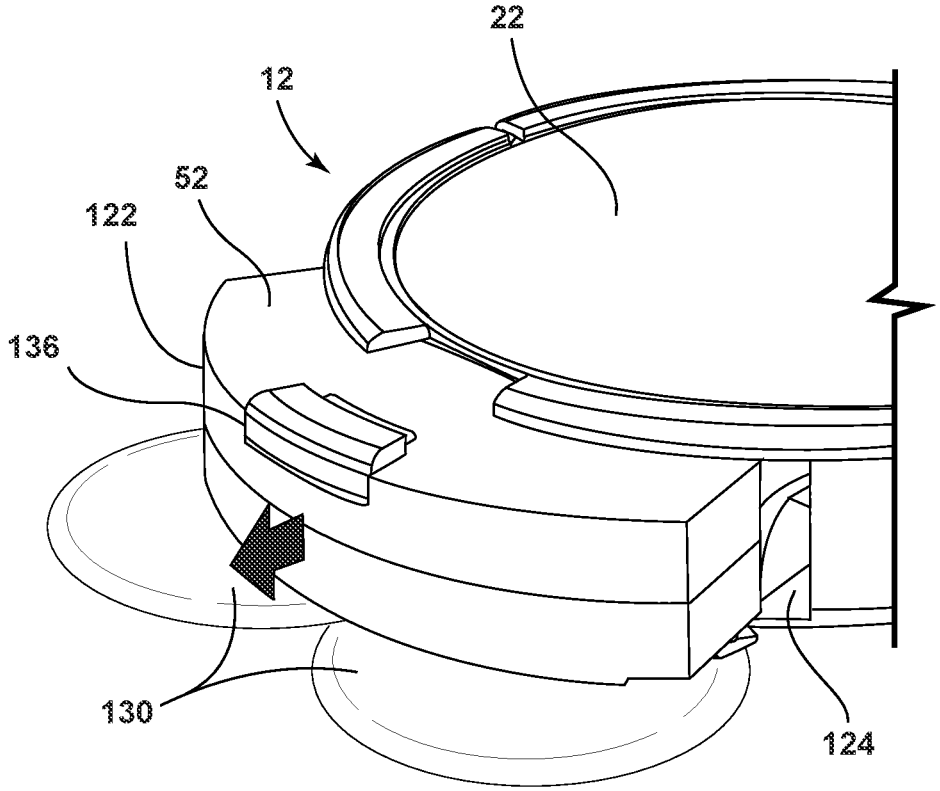
FIG. 5 is an enlarged view of portion of the robot, showing the installation of a wet module on the robot.

Referring to FIG. 4, the dry mode module or dry module 120 can include the collection bin 42. The dry module 120 can optionally include a latch 126 or other mechanism for securing the module 120 within the receiver 124. The dry module 120 is inserted into the receiver 124 for operation of the robot 12 in the dry mode. During the dry mode of operation, a partial vacuum can be generated at the suction nozzle 38 by the suction source 40 to collect liquid and/or debris in the collection bin 42. During the dry mode of operation, the brushroll 48 and/or edge brush 94 can be rotated. In the embodiment shown, the brushroll 48 and edge brush 94 remain on the housing 22 in both modes. In an alternative embodiment, one or both of the brushroll 48 and edge brush 94 can be included on the dry module 120.

The wet mode module or wet module 122 can include the supply tank 52. The wet module 122 can optionally include a mopping assembly 128. The mopping assembly 128 can include at least one mop pad 130 for mopping the floor surface. The mop pad 130 can comprise one or more different agitation or cleaning elements configured to mop the surface to be cleaned. Some non-limiting examples of cleaning elements for the mop pad 130 comprise a microfiber pad or a wet scrubbing pad. The mop pad 130 can be disposable or reusable. In the embodiment shown, the mopping assembly 128 includes two mop pad 130.

Referring to FIG. 3, a drive assembly including at least one mop pad motor 132 can be provided within the wet module 122 to drive the at least one mop pad 130. In the embodiment shown with multiple mop pads 130, the mop pad 130 can be operated by a common motor 132 or individual motors 132. The mop pad motor 132 is configured to drive at least a portion of the mop pad 130 about a substantially vertical rotational axis, relative to the surface to be cleaned. A mop pad motor driver 134 can be provided for controlling each mop pad motor 132. The motor driver 134 can act as an interface between the controller 30 and its respective motor. The motor driver 134 can be an integrated circuit chip (IC). It is also contemplated that a single mop pad motor driver 134 can control multiple mop pad motors 132 simultaneously.

The wet module 122 can optionally include a latch 136 or other mechanism for securing the module 122 within the receiver 124. The wet module 122 is inserted into the receiver 124 for operation of the robot 12 in the wet mode.

During the wet mode of operation, liquid from the supply tank 52 is applied to the floor surface and the mop pads 130 can be rotated. In one embodiment, the mopping assembly 128 can remove cleaning fluid and debris from the surface to be cleaned without the use of suction. Cleaning fluid and debris can be collected by the mop pads 130. In another embodiment, during the wet mode, a partial vacuum can be generated at the suction nozzle 38 by the suction source 40 to collect liquid and/or debris in a space onboard the robot 12. In one example, the wet module 122 can include a collection chamber for recovered liquid and/or debris.

The module receiver 124 can comprise suitable connections for establishing the flow of air, debris, cleaning fluid, and power, as required, between the modules and components within the housing 22. For example, the module receiver 124 can include suitable connections for establishing the flow of air and debris between the suction nozzle 38, suction source 40, and collection bin 42, i.e. through the working air path of the collection system 24. The module receiver 124 can include suitable connections for establishing the flow of cleaning fluid between the supply tank 52 and the distributor 54, i.e. through the supply path of the delivery system 25. The module receiver 124 can further include suitable connections for establishing the flow of power between the battery 81 and the mop pad motor or motors 132 of the wet module 122.

Figure 6:
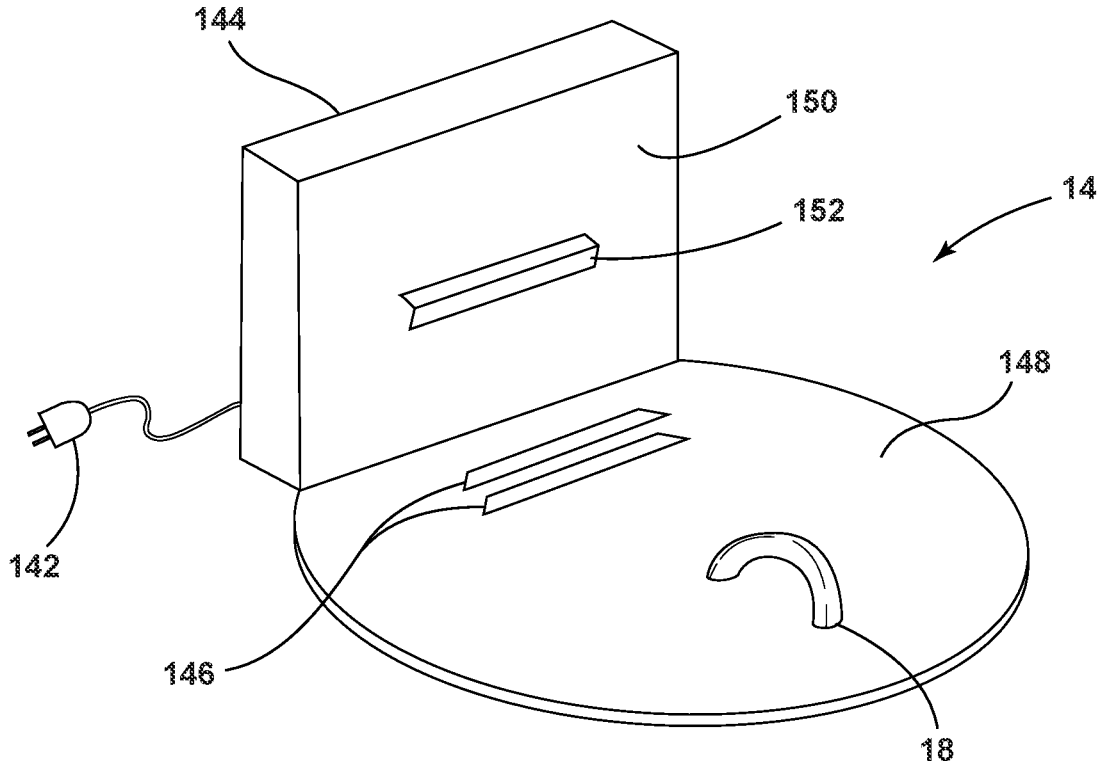
FIG. 6 is a front perspective view of one embodiment of a docking station for the system of FIG. 1.

FIG. 6 illustrates one embodiment of the docking station 14 for the system 10 of FIG. 1. It is noted that the docking station 14 shown in FIG. 6 is but one example of a dock that is usable with the system 10 and with the robot 12, and that other docks can be used with the system 10 and robot 12.

The docking station 14 can recharge a power supply of the robot 12 (e.g. battery 81). In one example, the docking station 14 can be connected to a household power supply, such as an A/C power outlet, and can include a converter 142 for converting the AC voltage into DC voltage for recharging the power supply on-board the robot 12.

The docking station 14 can include various sensors and emitters (not shown) for monitoring a status of the robot 12, enabling auto-docking functionality, communicating with the robot 12, as well as features for network and/or Bluetooth connectivity.

In another embodiment, in addition to or as an alternative to recharging the robot 12, the docking station 14 can perform service, maintenance, or diagnostic checks for the robot 12. For example, the docking station 14 can be configured to automatically empty the collection bin 42 and/or automatically fill or refill the supply tank 52. To perform service, maintenance, and/or diagnostic checks for the robot 12, the docking station 14 may first engage the lock 18 to physically interlock the robot 12 and docking station 14, and then proceed with performing at least one service, maintenance, and/or diagnostic check for the robot 12.

The docking station 14 includes a housing 144 and electrical contacts or charging contacts 146 disposed on the housing 144 that are adapted to mate with the charging contacts 82 on the exterior surface of the robot 12 to charge the battery 81 of the robot (see FIG. 3).

The housing 144 can have a base plate 148 and a backstop 150. The base plate 148 can extend generally horizontally to be disposed on the floor support. The backstop 150 is generally perpendicular to the floor surface on which the base plate 148 rests. Other shapes and configurations for the housing 144 are possible.

The robot 12 can dock by driving at least partially onto the base plate 148, optionally until the robot 12 meets the backstop 150. The charging contacts 146 of the docking station 14 can be located on the base plate 148, allowing them to contact corresponding contacts 82 on the underside 44 of the robot 12 when the robot 12 drives onto the base plate 148. Alternatively, the charging contacts 146 can be provided on the backstop 150, or other portion of the housing 144.

In one embodiment, positive and negative charging contacts 146 are utilized to detect a completed circuit when the robot 12 docks with the docking station 14. In other embodiments, a single charging contact 146 or more than two charging contacts 146 may be utilized. An additional charging contact would provide redundancy in the event that one of the other charging contacts becomes dirty, obstructed, or damaged. In still other embodiments of the docking station 14, additional contacts may be used to transmit data and information between the robot 12 and docking station 14.

The docking station 14 can include a portion of the interlock feature 16 for physically interlocking the robot 12 and docking station 14. As shown in FIG. 1, the docking station 14 can comprise the lock 18, which can be provided on the base plate 148. The lockable member 20 that is engaged by the lock 18 can be provided on the underside 44 of the robot 12. In another embodiment, the lock 18 can be provided on the underside 44 of the robot 12 and the lockable member 20 can be provided on the base plate 148 of the docking station 14. In yet another embodiment, the lock 18 can be provided on the backstop 150 and the lockable member 20 can be provided on a lateral side of the robot 12. In still another embodiment, the lock 18 can be provided on a lateral side of the robot 12 and the lockable member 20 can be provided on the backstop 150.

In one embodiment, when the wet module 122 is installed, and the robot 12 is docked with the docking station 14, the interlock 16 secures the robot 12 to the docking station 14 until a predefined criterion is met. The predefined criteria may be the removal of the wet module 122 from the housing 22 and the installation of the dry module 120. This can prevent a user from trying to fill the supply tank 52 under a faucet while the wet module 122 is installed on the robot 12, which can allow water spill into the interior of the robot 12. Instead, the interlock 16 encourages the user to separate the wet module 122 from the robot 12 before refilling by preventing separation of the robot 12 from the docking station 14 with the wet module 122 still installed. When the wet module 122 is removed and the dry module 120 installed in its place, the lock 18 can disengage from the lockable member 20, thereby permitting the robot 12 to be separated from the docking station 14. Optionally, if the dry module 120 is installed when the robot 12 docks with the docking station 14, the lock 18 does not engage the lockable member 20.

An activating switch 152 for controlling the lock 18 can be provided, and can be operable to move between an on and off position. When the activating switch 152 is on, the lock 18 is engaged. When the activating switch 152 is off, the lock 18 is disengaged. The activating switch is configured to be actuated, i.e. moved to the on position, when the robot 12 docks with the docking station 14.

In one embodiment, the activating switch 152 can comprise an optical switch on the docking station 14 that is occluded by the wet module 122, and not by the dry module 120, to indicate that the robot 12 is present with the wet module 122. When the robot 12 docks with the dry module 120, the optical switch is not occluded, and the lock 18 does not engage.

In another embodiment, the activating switch 152 can comprise a mechanical switch on the docking station 14 that is physically engaged by the robot 12 to move to the on position. In still another embodiment, the wet module 122, and not by the dry module 120, can comprise a switch actuator that physically engages the activating switch 152 when the robot 12 docks with the docking station 14. In such an embodiment, when the robot 12 docks with the dry module 120, the mechanical activating switch 152 is not physically engaged, and the lock 18 does not engage.

Optionally, an override control can be provided on the robot 12, the docking station 14, and/or on a smart device application executed on a mobile or remote device for disengaging the interlock 16 even when the predefined criteria is not met.

Figure 7:
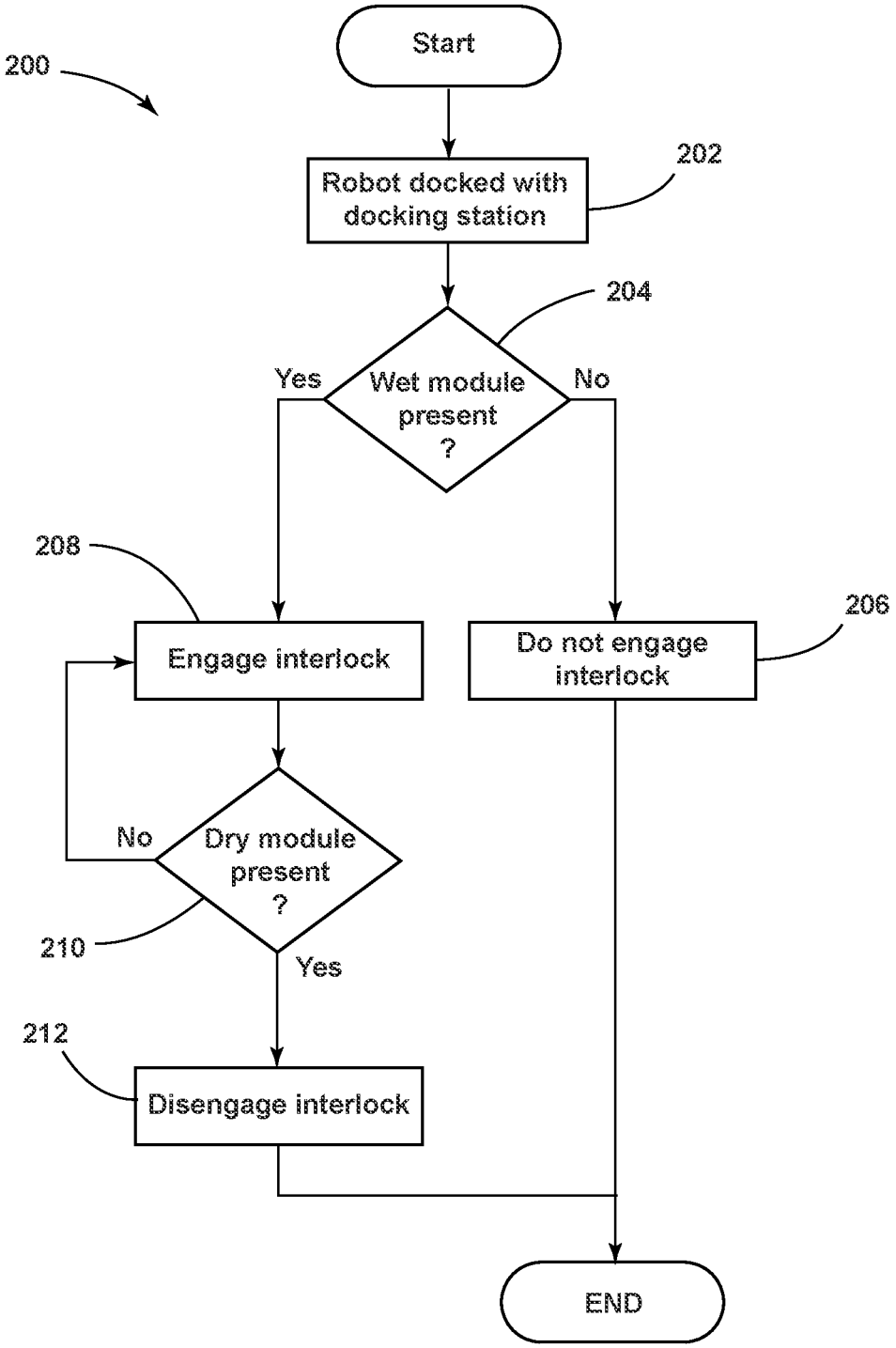
FIG. 7 is a flow chart showing one embodiment of a method for docking performed by the robot.

FIG. 7 is a flow chart showing one embodiment of a method 200 for docking the robot 12 at the docking station 14. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

At step 202, the robot 12 docks with the docking station 14. At step 204, it is determined whether the wet module 122 is present on the robot 12. If the wet module 122 is not present, the method 200 proceeds to step 206 and the interlock 16 remains disengaged. If the wet module 122 is present, the method 200 proceeds to step 208, and the interlock 16 engages. Subsequently, if the dry module 120 is swapped for the wet module 122, and it is determined that the dry module 120 is now present on the robot 12 at step 210, the interlock 15 is disengaged at step 212.

Figure 8:
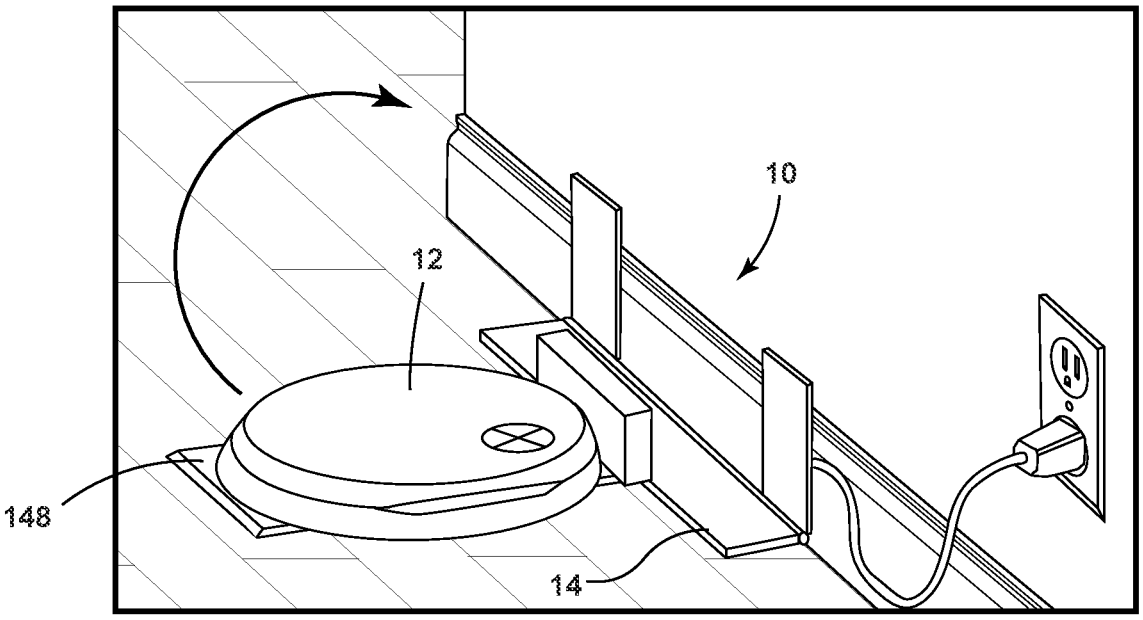
FIG. 8 is a schematic view of an autonomous floor cleaning system according to another embodiment of the invention, the system including at least an autonomous floor cleaner, or robot, and a docking station, showing the robot docked with the docking station and the docking station in a down position.
Figure 9:
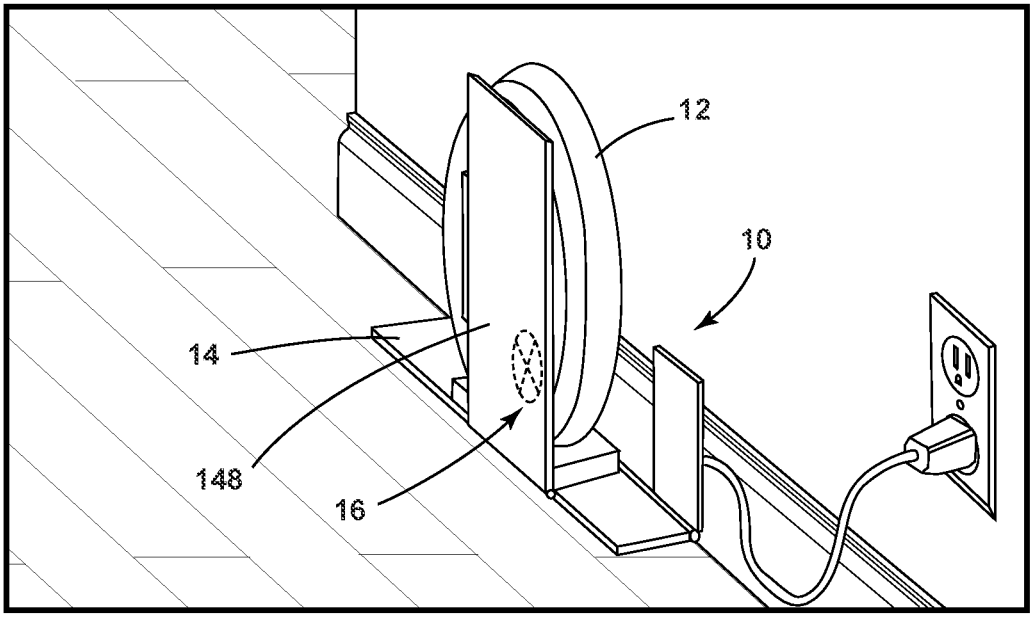
FIG. 9 is a schematic view of the autonomous floor cleaning system of FIG. 9, showing the docking station and robot in a stowed position.

FIGS. 8-9 are schematic views of an autonomous floor cleaning system 10 having an alternate embodiment of the docking station 14 according to another embodiment of the invention. The docking station 14 can fold down to receive the robot 12 as shown in FIG. 8, and can fold up to move the robot 12 to a substantially vertical position, or alternatively to another off-the-floor position, as shown in FIG. 9. The interlock feature 16 (shown in phantom line) can physically interlock the robot 12 and docking station 14 to lock the robot in place when moving from the down or docking position, an example of which is shown in FIG. 8, to the stowed position, an example of which is shown in FIG. 9. The foldable docking station 14 and interlock 16 improve the stowability of the docked robot 12. The docking station 14 can also fold up when the robot 12 is not docked for a more compact profile, which can allow the robot 12 to clean more floor space around the docking station 14.

In one embodiment, the base plate 148 of the docking station 14 can rotate up for storage. The base plate 148 of the docking station 14 can fold up and down automatically or manually. If automatic, the docking station 14 can rotate down and release the robot 12 for cleaning. Cleaning can be initiated manually by the user, or automatically during a scheduled cleaning time. The robot 12 docks with the docking station 14 upon a return-to-dock event, such as when cleaning is complete, when the battery 81 requires charging, the collection bin 42 (if present) requires emptying, and/or the supply tank (if present) requires filling, and the base plate 148 rotates up to stow the robot 12 until the next cleaning, until the battery 81 is recharged, the collection bin 42 (if present) is emptied, and/or the supply tank (if present) is filled.

Figure 10:
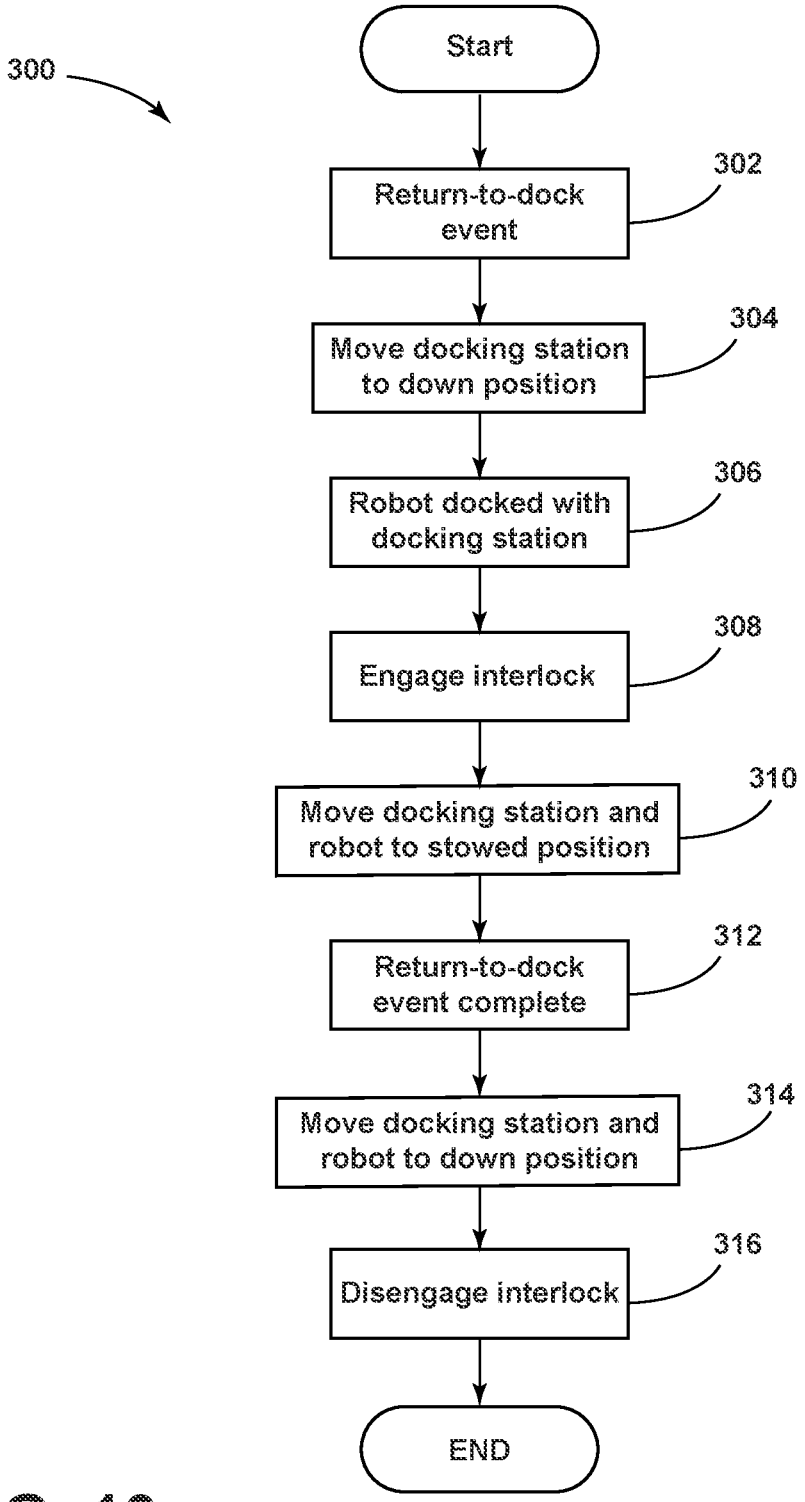
FIG. 10 is a flow chart showing one embodiment of a method for docking performed by the robot.

FIG. 10 is a flow chart showing one embodiment of a method 300 for docking the robot 12 at the docking station 14 described with respect to FIGS. 8-9. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

At step 302, a return-to dock event occurs. Examples of return-to-dock events include, but are not limited to, the completion of a cleaning cycle of operation, the battery 81 being below a predetermined level, a user commanding the robot 12 to dock (e.g. by pressing a dock or home button on the robot 12 or on a mobile device), the collection bin 42 being full, or the supply tank 52 being empty. At step 304, if necessary, the docking station 14 moves to the down or docking position. At step 306, the robot 12 docks with the docking station 14. At step 308, the interlock 16 engages. At step 310, the docking station 14, along with the robot 12, moves to the stowed position. This moves the robot 12 off the floor surface.

Optionally, upon competition of the return-to dock event at step 312, the docking station 14 can move to the down or docking position, lowering the robot 12 back to the floor surface. At step 316, the interlock 16 can disengage. The robot 12 is now free to leave the docking station 14.

Examples of a completion of a return-to-dock event for step 312 include, but are not limited to, the start of a cleaning cycle of operation, the battery 81 being charged, a user commanding the robot 12 to un-dock, the collection bin 42 being emptied, or the supply tank 52 being filled.

Any embodiment of the docking station 14 disclosed herein can include a dirt dump feature that removes debris from the robot 12 into a larger container with a plastic bag.

Any embodiment of the docking station 14 disclosed herein can include drain plumbing for that removes liquid from the robot 12 into a larger container or household drain line.

Any embodiment of the docking station 14 disclosed herein can include a supply feature for supplying cleaning fluid to the robot 12.

To the extent not already described, the different features and structures of the various embodiments of the invention, may be used in combination with each other as desired, or may be used separately. That one autonomous floor cleaning system, robot, or docking station is illustrated herein as having the described features does not mean that all of these features must be used in combination, but rather done so here for brevity of description. Any of the disclosed docking stations may be provided independently of any of the disclosed robots, and vice versa. Further, while multiple methods are disclosed herein, one of the disclosed methods may be performed independently, or more than one of the disclosed methods, including any combination of methods disclosed herein may be performed by one robot or docking station. Thus, the various features of the different embodiments may be mixed and matched in various cleaning apparatus configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular components or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. An autonomous floor cleaning system comprising:

an autonomous floor cleaner comprising a housing, a drive system configured to autonomously move the housing over a surface to be cleaned, a controller, a battery, a first charging contact, interchangeable modules, and a module receiver configured to receive one of the interchangeable modules at a time;

a docking station configured to dock the autonomous floor cleaner and comprising a second charging contact adapted to mate with the first charging contact to charge the battery of the autonomous floor cleaner; and an interlock feature that physically interlocks the autonomous floor cleaner and the docking station, the interlock feature comprising a lockable member and a lock engageable with the lockable member to interlock the autonomous floor cleaner to the docking station, wherein the autonomous floor cleaner comprises one of the lockable member and the lock, and the docking station comprises the other one of the lockable member and the lock;

wherein the interchangeable modules include at least:

a wet mode module comprising a supply tank configured to hold a liquid, the autonomous floor cleaner operable a wet mode of operation in which cleaning fluid is applied to the floor surface by the autonomous floor cleaner; and a dry mode module comprising a collection bin configured to hold collected debris, the autonomous floor cleaner operable in a dry mode of operation in which cleaning fluid is not applied to the surface to be cleaned by the autonomous floor cleaner;

wherein the docking station comprises a lock activating switch configured to activate the lock to engage the lockable member, wherein the lock activating switch comprises an optical switch configured to be occluded by the wet mode module and configured to be not occluded by the dry mode module.

2. The autonomous floor cleaning system of claim 1 wherein the lock comprises a shackle and the lockable member comprises an opening through which the shackle can pass.

3. The autonomous floor cleaning system of claim 1 wherein the lock comprises a U-shaped member on the docking station and the lockable member comprises an opening on the autonomous floor cleaner through which the U-shaped member can pass.

4. The autonomous floor cleaning system of claim 1 wherein the autonomous floor cleaner comprises at least one of:

a fluid delivery system configured to store a cleaning fluid and deliver the cleaning fluid to the surface to be cleaned, wherein the fluid delivery system comprises a supply tank and at least one fluid distributor in fluid communication with the supply tank; and a collection system with a working air path through the housing having an air inlet and an air outlet, a suction nozzle defining the air inlet, a suction source in fluid communication with the suction nozzle, and a collection bin.

5. The autonomous floor cleaning system of claim 1 wherein the wet mode module comprises at least one mop pad configured to mop the surface to be cleaned.

6. The autonomous floor cleaning system of claim 1 wherein the interlock feature is configured to physically interlock the housing to the docking station without physically interlocking the wet mode module to the docking station, such that the wet mode module is removable from the module receiver with the lock engaged with the lockable member.

7. The autonomous floor cleaning system of claim 1 wherein the docking station comprises a housing having a base plate and a backstop, the base plate extending substantially horizontally to be disposed on a floor support and the backstop being substantially perpendicular to the floor support on which the base plate rests.

8. The autonomous floor cleaning system of claim 7 wherein the autonomous floor cleaner comprises the one of the lockable member and the lock on an underside of the housing and the base plate of the docking station comprises the other one of the lockable member and the lock.

9. The autonomous floor cleaning system of claim 1 wherein the docking station comprises a foldable portion moveable between a docking position and a stowed position, wherein the autonomous floor cleaner is dockable with the docking station in the docking position, and the autonomous floor cleaner is raised off a floor surface in the stowed position.

10. A method for docking an autonomous floor cleaner with a docking station, the method comprising:

docking an autonomous floor cleaner at a docking station;

determining if a predefined locking criterion is met;

automatically interlocking the autonomous floor cleaner with the docking station if the predefined locking criterion is met by engaging a lock on one of the autonomous floor cleaner and the docking station with a lockable member on the other one of the autonomous floor cleaner and the docking station;

determining if a predefined unlocking criterion is met; and automatically unlocking the autonomous floor cleaner from the docking station if the predefined unlocking criterion is met;

wherein determining if the predefined unlocking criterion is met comprises determining if a dry mode module is present on the autonomous floor cleaner, the dry mode module comprising a collection bin configured to hold collected debris; and wherein automatically unlocking the autonomous floor cleaner from the docking station if the predefined unlocking criterion is met comprises automatically unlocking the autonomous floor cleaner from the docking station if the dry mode module is present on the autonomous floor cleaner.

11. The method of claim 10, wherein determining if the predefined locking criterion is met comprises determining if a wet mode module is present on the autonomous floor cleaner, the wet mode module comprising a supply tank configured to hold a liquid, and wherein automatically interlocking the autonomous floor cleaner with the docking station by locking the autonomous floor cleaner to the docking station if the predefined locking criterion is met comprises automatically interlocking the autonomous floor cleaner with the docking station by locking the autonomous floor cleaner to the docking station if the wet mode module is present on the autonomous floor cleaner.

12. The method of claim 10, comprising moving the autonomous floor cleaner from a docking position to a stowed position after interlocking the autonomous floor cleaner with the docking station.

13. The method of claim 12, wherein moving the autonomous floor cleaner from the docking position to the stowed position comprises folding a portion of the docking station upwardly and raising the autonomous floor cleaner into a substantially vertical storage position.

14. The method of claim 12, comprising moving the autonomous floor cleaner back to the docking position if the predefined unlocking criterion is met.

15. The method of claim 10, wherein docking the autonomous floor cleaner at the docking station comprises driving the autonomous floor cleaner at least partially onto a base plate of the docking station until the autonomous floor cleaner meets a backstop of the docking station.

16. A method for docking an autonomous floor cleaner with a docking station, the method comprising:

docking an autonomous floor cleaner at a docking station;

interlocking the autonomous floor cleaner with the docking station by engaging a lock on one of the autonomous floor cleaner and the docking station with a lockable member on the other one of the autonomous floor cleaner and the docking station;

determining if a dry mode module is present on the autonomous floor cleaner, the dry mode module comprising a collection bin configured to hold collected debris; and automatically unlocking the autonomous floor cleaner from the docking station if the dry mode module is present on the autonomous floor cleaner.

17. The method of claim 16, comprising moving the autonomous floor cleaner from a docking position to a stowed position after interlocking the autonomous floor cleaner with the docking station.

18. The method of claim 17, wherein moving the autonomous floor cleaner from the docking position to the stowed position comprises folding a portion of the docking station upwardly and raising the autonomous floor cleaner into a substantially vertical storage position.

19. The method of claim 16, wherein docking the autonomous floor cleaner at the docking station comprises driving the autonomous floor cleaner at least partially onto a base plate of the docking station until the autonomous floor cleaner meets a backstop of the docking station.

* * * * *